US005967469A

United States Patent [19]

Wade

[11] Patent Number: 5,967,469

[45] Date of Patent: Oct. 19, 1999

[54] FOLDABLE SANDBAG HOLDER

[76] Inventor: David Wade, 10633 Middleton Rd., Phelan, Calif. 92371

[21] Appl. No.: 09/137,270

[22] Filed: Aug. 20, 1998

[51] Int. Cl.[6] ..... B65B 67/04

[52] U.S. Cl. ..... 248/100

[58] Field of Search ..... 248/95, 97, 99, 248/100, 101, 150, 158, 175, 907

[56] References Cited

U.S. PATENT DOCUMENTS

| | | | |
|---|---|---|---|
| 906,794 | 12/1908 | Hall | 248/100 |
| 3,028,134 | 4/1962 | Nolen | 248/907 X |
| 4,304,378 | 12/1981 | Briggs | 248/97 |

*Primary Examiner*—Ramon O. Ramirez
*Attorney, Agent, or Firm*—Goldstein & Canino

[57] ABSTRACT

A foldable sandbag holder for supporting a conventional sandbag in an upright open-mouthed position, comprising a rear frame member having two rear vertical rods which are braced by means of crossbars extending therebetween, and a pair of side members, each side member having a front vertical rod. The side members are pivotally connected to the rear vertical rods and are movable between a flat configuration wherein the side members are folded against the rear frame member and an open rectangular configuration wherein the side members are positioned generally transversely with respect to the rear frame member. The front and rear vertical rods have pointed upper ends for piercing through the peripheral end portion of a sandbag to maintain the bag in an upright position with the mouth thereof spread open, so that it can be easily filled with sand. The vertical rods also have pointed lower ends for penetrating the ground to provide stability during filling operation.

2 Claims, 3 Drawing Sheets

FOLDABLE SANDBAG HOLDER

BACKGROUND OF THE INVENTION

This invention relates to a foldable sandbag holder. More particularly, the invention relates to a foldable sandbag holder employing a rear frame member and side members pivotally connected to the rear frame member which can be opened in a substantially rectangular configuration for supporting a sandbag in an upright position.

Many circumstances exist in which it is necessary to fill hundreds and thousands of sandbags with sand in order to avoid a disastrous situation. For example, in case of floods and mudslides, numerous sandbags are needed to form temporary barriers to protect buildings and property from water and mud. Typically, the filling of the sandbags involves having one person hold open a sandbag while another person fills the bag with sand. Such a traditional method of filling sandbags lacks efficiency since two individuals are needed to accomplish the task. Thus, it is desirable to have a sandbag holder that enables each person to fill sandbags by himself and thereby permitting rapid production thereof during emergency situations when time is of essence.

Several references uncovered in the prior art describe various portable devices for filling sandbags. For example, U.S. Pat. No. 4,576,350 to Bond discloses a portable support stand for holding a number of bags while being filled with sand. Another prior art reference describe a sand bag filling machine for producing sandbags, and such prior art device is disclosed in U.S. Pat. No. 4,044,921. Despite all these sandbag filling devices, there is still a further need to provide an improved sandbag holder. Such a sandbag holder should be simple in construction so as to minimize manufacturing cost, and yet be capable of supporting a conventional bag in an upright position so that it can be easily filled with sand, gravel, dirt, and the like. Moreover, such a sandbag holder should be capable of being folded in a flat, compact configuration for easy storage and transport, when not in use.

While these units mentioned above may be suitable for the particular purpose employed, or for general use, they would not be as suitable for the purposes of the present invention as disclosed hereafter.

SUMMARY OF THE INVENTION

It is an object of the invention to provide a foldable sandbag holder which is simple in construction so as to minimize manufacturing cost, and yet is capable of supporting a conventional bag in an upright position so that it can be easily filled with sand, gravel, dirt, and the like.

It is another object of the invention to provide a sandbag holder employing four vertical rods, each having a pointed lower end for penetrating the ground, which are effective in promoting stability during filling operation, as well as, effective in preventing the sandbag holder from accidentally folding up, when the pointed lower ends are properly driven into the ground.

It is yet another object of the invention to provide a sandbag holder which, when not being used, can be folded in a flat, compact configuration for easy storage and handling.

The invention is a foldable sandbag holder for supporting a conventional sandbag in an upright open-mouthed position, comprising a rear frame member having two rear vertical rods which are braced by means of crossbars extending therebetween, and a pair of side members, each said member having a front vertical rod. The side members are pivotally connected to the rear vertical rods and are movable between a flat configuration wherein the side members are folded against the rear frame member and an open rectangular configuration wherein the side members are positioned generally transversely with respect to the rear frame member. The front and rear vertical rods have pointed upper ends for piercing through a sandbag to maintain the bag in an upright position with the mouth thereof spread open, so that it can be easily filled with sand. The vertical rods also have pointed lower ends for penetrating the ground to provide stability during filling operation.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
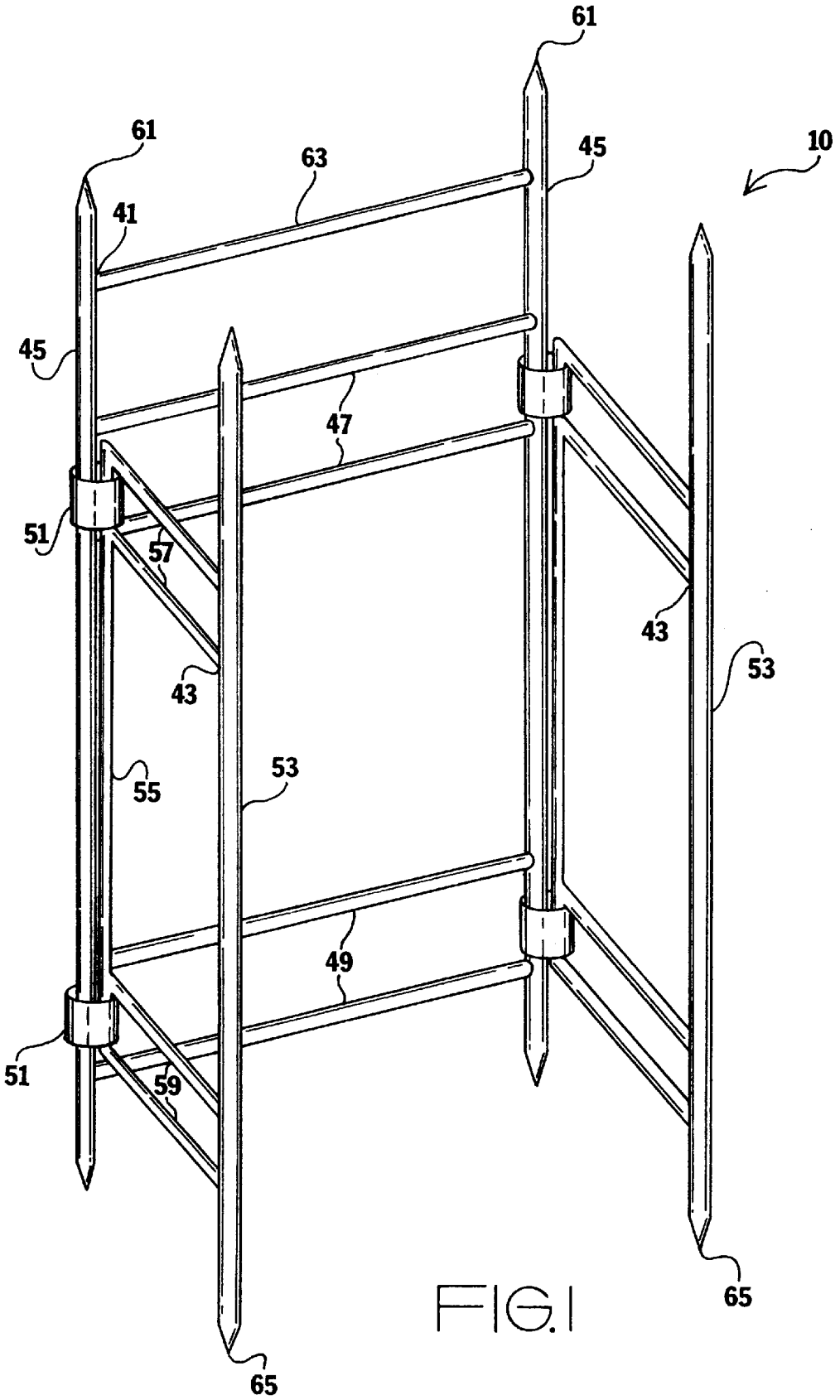
FIG. 1 is a diagrammatic perspective view a preferred embodiment of a foldable sandbag holder in an open rectangular configuration.
Figure 3:
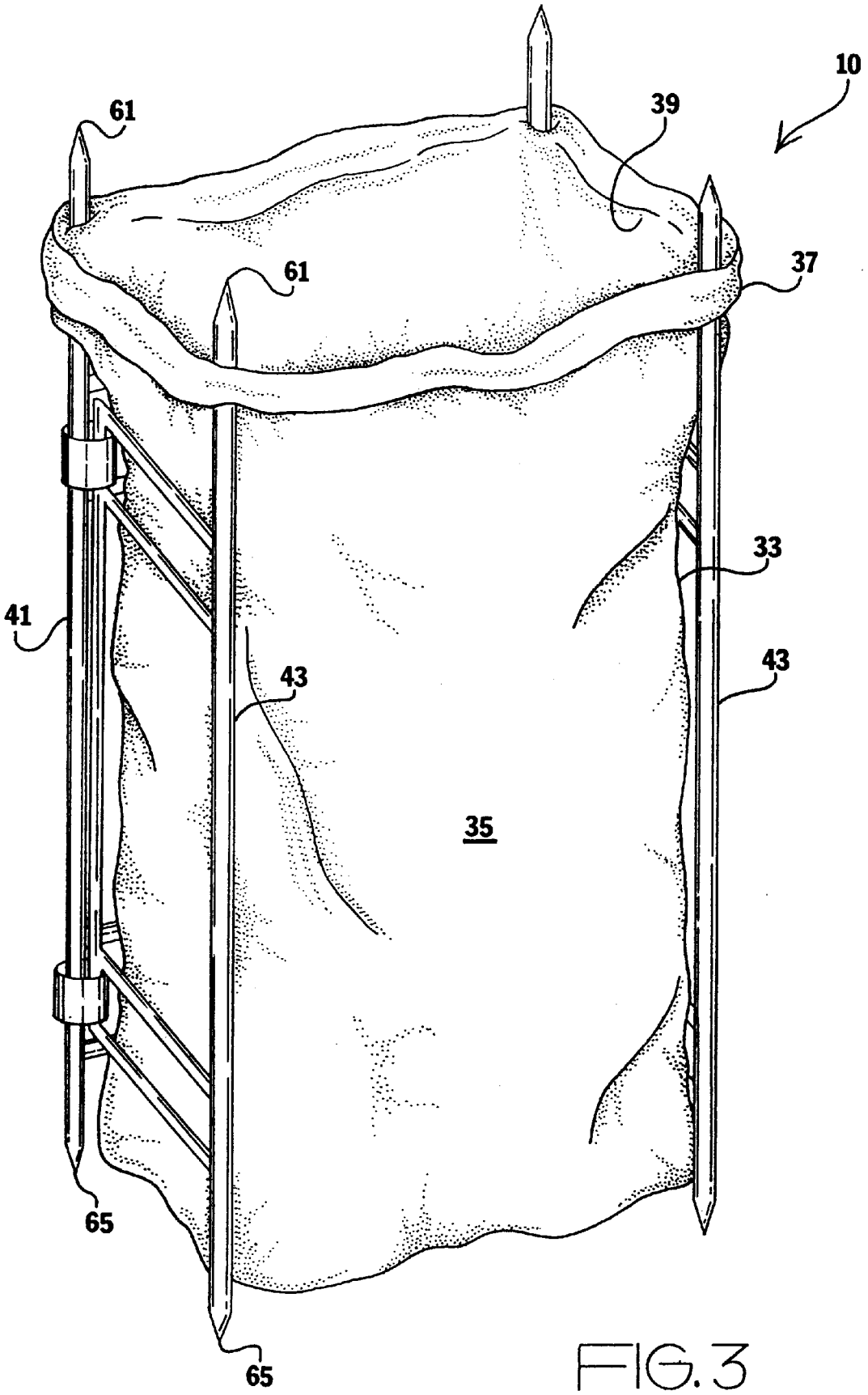
FIG. 3 is a diagrammatic perspective view of the foldable sandbag holder being used in accordance with the principles of the present invention.

FIG. 1 illustrates a preferred embodiment of a foldable sandbag holder 10 in accordance with the principles of the present invention. For a better understanding of the present invention, a conventional sandbag 33 is shown in FIG. 3 having a flexible body 35, a peripheral end portion 37, and an open mouth 39 for receiving sand. As will be seen in the following paragraphs, the sandbag holder 10 of the present invention is designed for supporting the conventional sandbag 33 in an upright open-mouthed position so that it can be easily filled with sand and the like.

Figure 2:
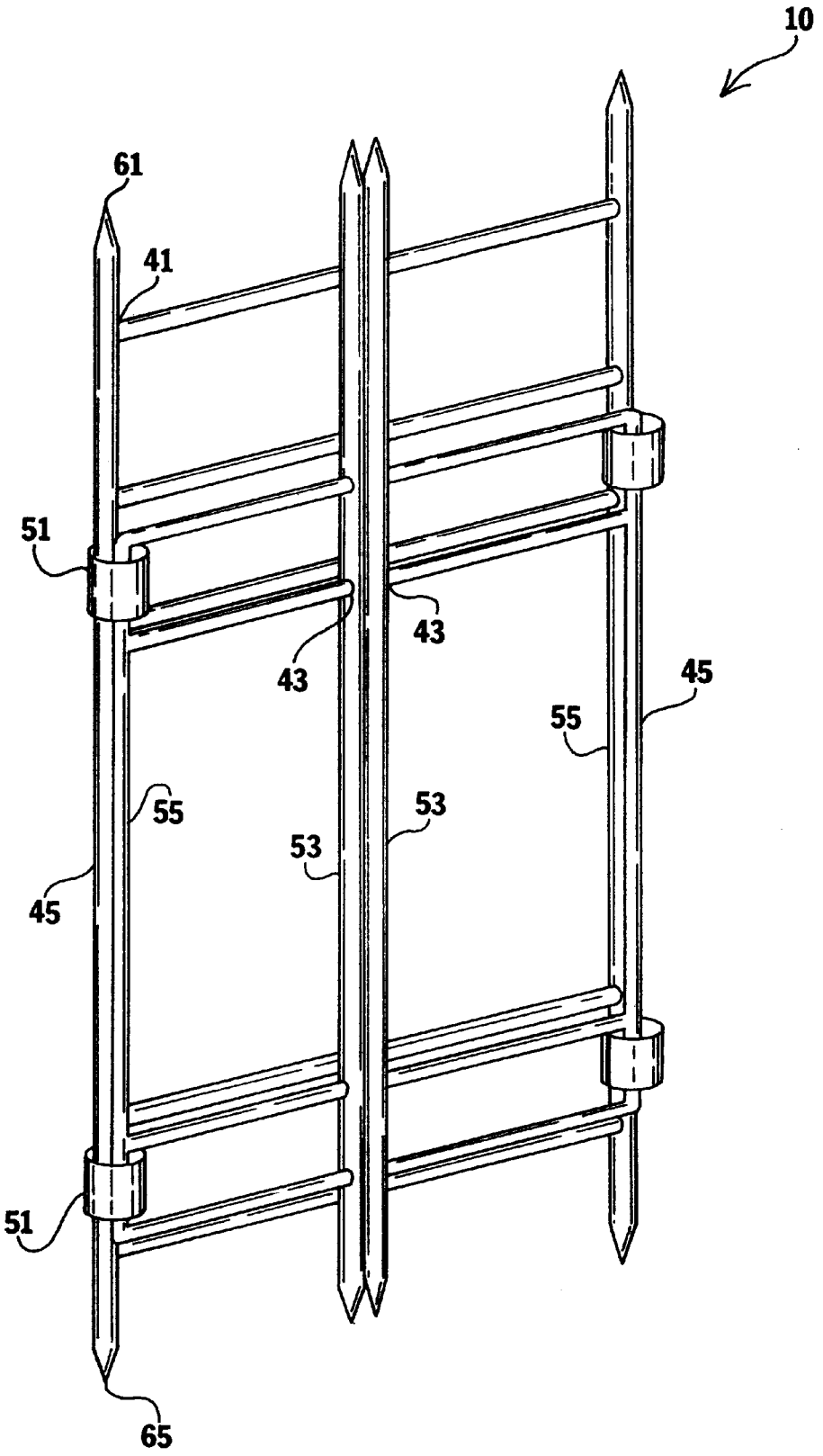
FIG. 2 is a diagrammatic perspective view of the sandbag holder folded in a flat configuration.

Referring back to FIG. 1, the sandbag holder 10 includes a rear frame member 41 and a pair of side members 43 pivotally mounted to either ends of the rear frame member 41. The side members 43 are movable between a flat configuration, as shown in FIG. 2, wherein the side members 43 are folded against the rear frame member 41 and an open rectangular configuration, as shown in FIG. 1, wherein the side members 43 are positioned generally transversely with respect to the rear frame member 41. The rear frame member 41 and side members 43 can be constructed of steel or any other suitably durable material.

The rear frame member 41 comprises two rear vertical rods 45 which are braced by means of upper 47 and lower 49 crossbars extending between the rear vertical rods 45. At least one tubular piece 51 is welded to each of the rear vertical rods 45 for pivotally supporting the side members 43. Each side members 43 comprises a front vertical rod 53 and a connection bar 55 which are joined together by upper 57 and lower 59 braces extending therebetween. The connection bars 55 of the side members 43 are mounted in the tubular pieces 51 carried by the rear frame member 41 to permit rotational movement.

Referring to FIGS. 1 and 3, the front 53 and rear 45 vertical rods have pointed upper ends 61 for piercing through a sandbag 33 at the peripheral end 37 such that the mouth 39 of the bag is kept wide open during the filling operation. The uppermost crossbar 63 of the rear frame member 41 serves to prevent the sandbag 33 from sliding down when the bag is pierced through the pointed upper ends of the vertical rods. The front and rear vertical rods also have pointed lower ends 65 for penetrating the ground to provide stability during filing operation. In addition, when the pointed lower ends 65 of the vertical rods 45 and 53 are properly secured into the ground, they serve to maintain the sandbag holder in the rectangular configuration and prevent the side members from inadvertently collapsing during usage.

The operation of the foldable sandbag holder 10 will now be described. When the need to produce sandbags arises, the side members 43 of the holder are rotated outwardly to form an open rectangular configuration, whereupon the pointed lower ends 65 of the vertical rods are driven into the ground to provide stability during filling operation. As seen by referring to FIG. 3, the peripheral end portion 37 of the bag 33 is first folded over and is then pierced through the pointed upper ends 61 of the vertical rods to maintain the bag in an upright position with the mouth thereof spread open, so that it can be easily filled with sand. When the bag is pierced through the pointed upper ends of the vertical rods, the uppermost crossbar 63 of the rear frame member contacts the folded peripheral end portion of the bag and prevents the bag from sliding down further. In this manner, the sandbag holder 10 of the present invention is effective in increasing efficiency since only one person is required to perform the filling operation. Finally, by folding the side members 43 against the rear frame member 41, the sandbag holder may be collapsed into a flat, compact configuration for convenient storage and handling.

Many specific details contained in the above description merely illustrate some preferred embodiments and should not be construed as a limitation on the scope of the invention. Many other variations are possible.

What is claimed is:

1. A sandbag holder for supporting a conventional sandbag in an upright position, said bag having an open mouth, comprising:

a) a rear frame member having a pair of rear vertical rods and at least one crossbars interconnecting the rear vertical rods;

b) a pair of side members, each having a front vertical rod, a connection bar, and upper and lower braces, wherein said braces interconnect the front vertical rod to said connection bar, as well as interconnecting said front vertical rod to the rear vertical rods such that the front vertical rods are positioned generally transversely with respect to the rear vertical rods, wherein the connection bar is parallel to the front vertical rod; and c) said rear and front vertical rods having pointed upper ends for piercing through said sandbag adjacent to its mouth so as to maintain said sandbag in an upright position with the mouth thereof spread open, and pointed lower ends for penetrating the ground to provide stability during filling operation;

d) pivotal connection means for pivotally mounting the side members to the rear frame member such that the side members are movable between a flat configuration wherein the side members are folded against the rear frame member and an open rectangular configuration wherein the side members are positioned generally transversely with respect to the rear frame member, wherein said pivotal connection means comprises at least one tubular piece affixed to each of the rear vertical rods for rotatably receiving said connection bars of the side members.

2. The sandbag holder as recited in claim 1, wherein the rear frame member and side members are constructed of steel.

* * * * *